US005099762A

United States Patent [19]

Drapala

[11] Patent Number: 5,099,762

[45] Date of Patent: Mar. 31, 1992

[54] ELECTROSTATIC DISCHARGE IMMUNE ELECTRIC INITIATOR

[75] Inventor: Thaddeus R. Drapala, Canyon Country, Calif.

[73] Assignee: Special Devices, Incorporated, Newhall, Calif.

[21] Appl. No.: 623,286

[22] Filed: Dec. 5, 1990

[51] Int. Cl.[5] ..... F42B 3/18

[52] U.S. Cl. ..... 102/202.1; 102/202.2

[58] Field of Search ..... 102/202.1, 202.2

[56] References Cited

U.S. PATENT DOCUMENTS

| | | | |
|---|---|---|---|
| 2,802,421 | 8/1957 | Horne et al. | 102/202.7 |
| 2,818,020 | 12/1957 | Burkland | 102/202.1 |
| 3,018,733 | 1/1962 | Johnson | 102/70.2 |
| 3,180,262 | 4/1965 | Talley et al. | 102/202.2 |
| 3,306,202 | 2/1967 | Menichelli et al. | 102/28 |
| 3,343,491 | 9/1967 | Peters, Jr. | 102/70.2 |
| 3,572,247 | 3/1971 | Warshall | 102/28 |
| 3,640,224 | 2/1972 | Petrick et al. | 102/28 |
| 3,783,788 | 1/1974 | Hayashi | 102/202.5 |
| 3,793,954 | 2/1974 | Johnston | 102/202.2 |
| 3,804,018 | 4/1974 | Janoski | 102/28 M |
| 3,966,224 | 6/1976 | Campbell et al. | 280/735 |
| 4,261,263 | 4/1981 | Coultas et al. | 102/202.7 |
| 4,378,738 | 4/1983 | Proctor et al. | 102/202.2 |
| 4,384,734 | 5/1983 | Yashui | 280/735 |
| 4,438,424 | 3/1984 | Yashui | 340/52 H |
| 4,592,280 | 6/1986 | Shores | 102/202.2 |
| 4,845,377 | 7/1989 | Swart | 307/10.1 |
| 4,851,705 | 7/1989 | Musser et al. | 307/10.1 |
| 4,893,109 | 1/1990 | Vrable et al. | 340/438 |
| 4,933,570 | 6/1990 | Swart et al. | 307/10.1 |
| 4,938,504 | 7/1990 | Fekuda et al. | 280/731 |
| 4,944,224 | 7/1990 | Fiedler et al. | 102/202.2 |
| 4,967,665 | 11/1990 | Baginski | 102/202.2 |

*Primary Examiner*—Charles T. Jordan
*Attorney, Agent, or Firm*—Robert Louis Finkel

[57] ABSTRACT

An electro-explosive initiator which may be either a coaxial or floating case type, for example, and which is constructed to be immune from the effects of electrostatic discharges. The initiator includes a bridgewire and contact pins for carrying an electric igniting signal to the bridgewire. The initiator has a discrete capacitor connected across the contact pins to shunt out the energy resulting from an electrostatic discharge pulse, and for preventing such energy from reaching the bridgewire.

5 Claims, 4 Drawing Sheets

ELECTROSTATIC DISCHARGE IMMUNE ELECTRIC INITIATOR

BACKGROUND OF THE INVENTION

The invention is concerned with electro-explosive devices or "initiators", and it has particular application to initiators which are known to the art as "squibs". The invention is directed to an improved squib or initiator which is constructed to be immune from premature firing by static electricity.

As discussed in U.S. Pat. No. 2,802,421, which issued Aug. 13, 1957, the art has long recognized the dangers in the accidental discharge of electric initiators by static electricity. Accidents, which at the time of their occurrence seemed without explanation, have been subsequently traced to the firing of an initiator by a static electricity discharge. Since conventional ignition compositions necessarily are highly heat sensitive, a discharge of relatively high voltage from static electricity is quite capable of igniting the composition and firing the initiator. The art has generally considered that accidental firings result from a direct static discharge from a lead wire to the metallic case of an initiator in the locus of the ignition composition.

The danger of premature firing due to static discharge is present in all types of electric initiators. A structure has previously been proposed in the prior art in which a lead wire is disposed in contact or almost in contact with the metallic case of the initiator, at a point removed from the ignition composition, in order to provide for a discharge of the static electricity from the lead wire to the case. However, this type of structure offers good protection from static or firing of the initiator only when the charge passes down the one lead wire to the case. Little or no benefit is obtained when the current passes through both lead wires. Even when both lead wires are so disposed, discharge will occur from only one wire in many instances, and protection will be limited as far as heating of the bridge wire is concerned.

A structure has also been proposed in the prior art wherein one or both of the lead wires are connected to the metallic case of the initiator by means of semiconductive material outside the locus of the ignition composition. This construction affords a considerable improvement in resistance to static discharge. However, it is very difficult with such a structure to maintain a proper balance of conductivity that will allow a discharge from both wires to the case and still have sufficient resistance for protection against the low voltage currents which attend many commercial operations. Additionally it has been found that in some instances, the static resistance of this type of structure diminishes with storage. Furthermore, such initiators have been known to fire when 10–40 volts from a battery are applied between the lead wires and shell.

In another proposed structure, conductive material is disposed about the bared lead wires and extends to the case. This conductive material acts as a true resistor in that the resistance is low, normally form 10–100 ohms. The resistance of such a body of material is similar to that of a regular carbon resistor, being fairly constant, but subject to variation due to temperature. The resistance does not change greatly due to passage of current until the current is sufficient to cause heating. This type of initiator gives good static protection in most instances. However, it has been found that in some instances discharge occurs from only one wire which allows a firing of the initiator by the heating of the bridge wire. Even more than in the case of semiconductive material, this structure has a serious deficiency of insulation from case to lead wires and can be fired in this manner with a very low voltage. In other words, this structure, while removing a considerable part of the hazard of static electricity, has introduced an equally undesirable hazard in the form of undesirably low resistance between lead wires and case..

In still another structure, it has been proposed to equipt the bared lead wires with protrusions which extend toward the metallic case. This structure is usually employed with a matchhead ignition element which is insulated. However, a discharge usually takes place from only one wire and a firing of the initiator by the heating of the bridge wire is thus permitted. In addition, a hotter spark is obtained when the discharge is directed from localized points. Even though the protrusions are outside the locus of the ignition composition, such violent discharges are to be avoided when the same results can be obtained in a less violent manner.

While all of the initiators described exhibit a measure of resistance to static electricity discharges, it will be seen that in each case, the protection from static electricity is not complete and, in most instances, what protection is obtained is brought about by a structure which is characterized by low voltage breakdown.

Ignitors have found widespread use as airbag inflators in motor vehicles. The initiator commonly used in such applications is a two-pin squib with a "floating" electrically conductive case. In such an initiator, the firing signal is applied by way of an electric circuit located within the case, but insulated therefrom, the electric circuit being connected to the pins of the squib to energize a bridgewire within the squib. In the two-pin squib, the bridgewire is connected between the two-pins rather than between one pin and the case, as is the case in the coaxial type of squib.

Specific attempts have been made in the prior art to render the "floating" case initiator described in the preceding paragraph immune from electrostatic discharges. These attempts have included the use of a "leaky" insulator. As described in U.S. Pat. No. 3,783,788, electrostatic charges accumulating between the pins, or between either pin and the case, are dissipated by a low-level current flow through the insulator. However, this approach has met with but limited success. Another attempt in the prior art to render such initiators immune from electrostatic discharges has involved the use of Zener diodes connected between the pins and between each pin and the case. This arrangement also is met with only limited success, and has proven to be cost prohibitive.

U.S. Pat. No. 4,261,263, assigned to the present assignee, describes and claims yet another approach to immunity from radio frequency signals and electrostatic discharges, which has proven to be highly successful. The initiator described in the discharge of radio frequency and electrostatic energy, the spark gap being isolated from the pyrotechnic charge within the initiator.

An objective of the present invention is to provide an improved and simple initiator which may be of the "floating" case. type or of the coaxial type, and which is constructed to exhibit high immunity to electrostatic discharges resulting from ambient electrostatic fields.

The electrostatic discharge test specifications of m automobile manufacturing companies requires that a 500 pf capacitor charged to 25 kilvolts be discharged through the initiator by way of a 5 kilo-ohm series resistor. In the case of the floating casing type of initiator, the test is specified to be conducted in three formats, namely pin-to-pin, each pin-to-case, and the short-circuited pins-to-case. The electrostatic discharge test specification for one major automobile manufacturer requires that a 150 pf capacitor charged to 25 kilvolts be discharged through a 150 ohm series resistor.

The latter test dissipates approximately 10 times the energy in the initiator as compared with the former test, and this has resulted in a high number of firings in the lead-to-lead 1 test mode when the prior art initiators were tested. This is because the energy dissipated in the bridgewire is comparable with the energy required to fire the initiator. For that reason, the prior art initiators for the most part have been found to fail the severe test.

SUMMARY OF THE INVENTION

The present invention provides an initiator which may be the floating case type or the coaxial type, and which includes a capacitor connected across its terminal pins. The capacitor serves to shunt the major part of any electrostatic discharge pulse away from the bridgewire, thereby substantially reducing the energy dissipated by the bridgewire in response to such a pulse. The initiator of the invention has proven to be immune to electrostatic discharges, even when subjected to the severe test described above.

It should be pointed out that radio frequency filters have been used in the prior art to protect initiators from spurious firings due to exposure to radio-frequency energy an arrangement is disclosed, for example, in U.S. Pat. 3,343,491. However, the prior art demonstrates that such filters are normally used to protect the initiator from the effects of radio frequency signals. It is well known that the electrostatic discharge is not an alternating current signal, so that the use of a capacitor to dissipate electrostatic energy is clearly unobvious. The capacitor has been found to be operational because the electrostatic discharge is in the form of a pulse which contains high frequency components due to its transient nature, and these components travel a low impedance path through the capacitor. Accordingly, there is no teaching in the prior art of a firing circuit for an initiator which includes a capacitor connected across the pins of the initiator for the purpose of rendering the initiator immune to electrostatic discharges.

DETAILED DESCRIPTION OF THE PREFERRED EMBODIMENT

Figure 1:
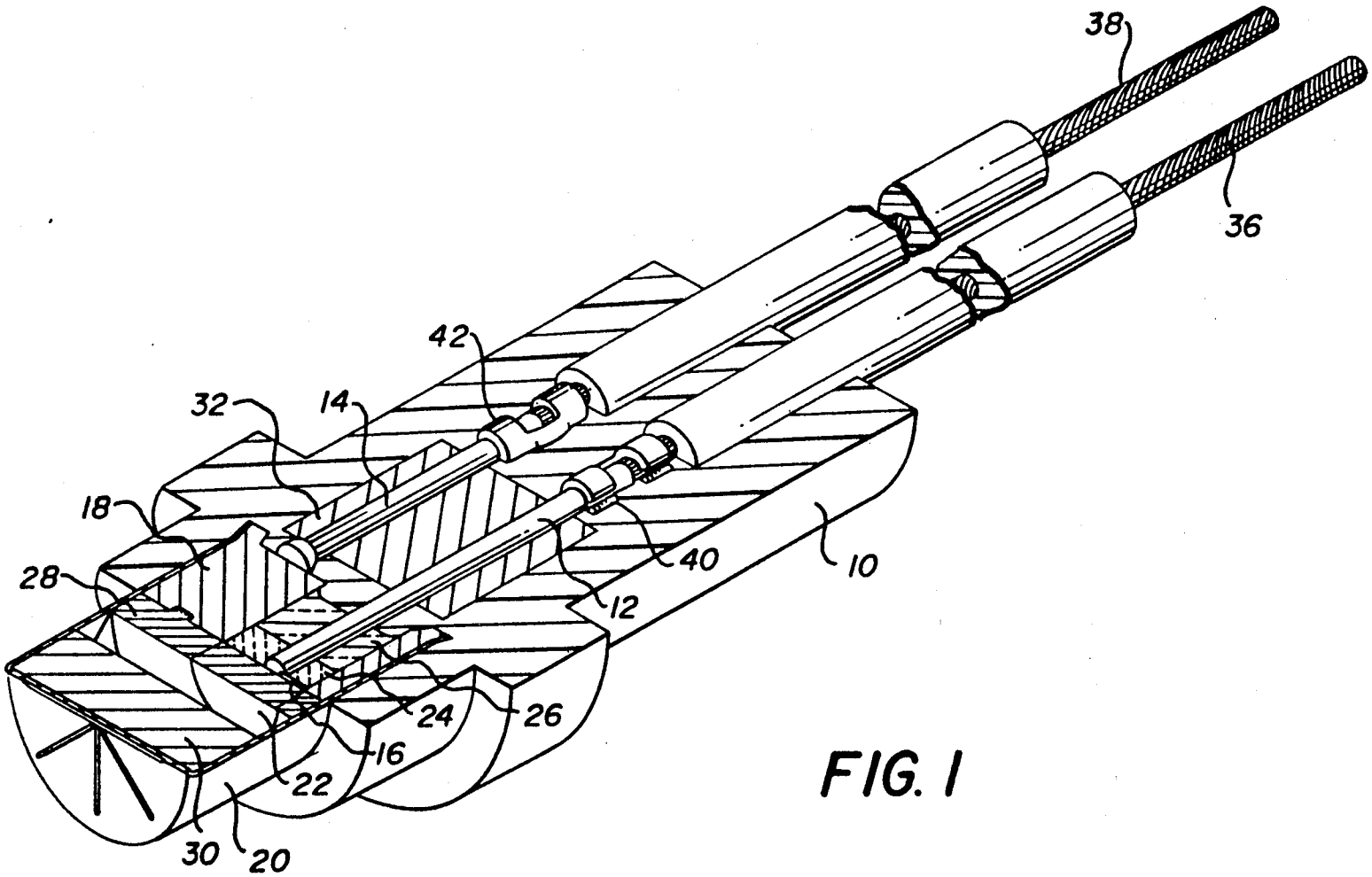
FIG. 1 is a perspective sectional view of a typical coaxial type initiator which may be conditioned, in accordance with the teachings of the present invention to be immune to from electrostatic discharges.

The initiator shown in FIG. 1 includes a body 10 formed of nylon or other appropriate material. A pair of terminal pins 12 and 14 are supported within body 10. Terminal pin 12 is connected to one end of a bridgewire 16, and terminal pin 14 is connected to a header 18 which, in turn, is connected to a grounded case 20. The other end of bridgewire 16 is connected to the grounded case 20 by way of header 18. An ignition charge 22 is supported in the casing 20 adjacent to the bridgewire, with the bridgewire being sandwiched between a ceramic chip 24 and the ignition charge 22. A glass seal 26 is mounted in body 10 adjacent to the ceramic chip 24. The ignition charge 22 is mounted with a sleeve 28. An output charge 30 is mounted in casing 20 adjacent to the ignition charge 22 but axially spaced from the ignition charge.

A radio-frequency filter 32 is interposed between the pins 12 and 14 to absorb any radio-frequency signal and prevent spurious ignition of the initiator by such signals. The pins 12 and 14 are connected to appropriate lead wires 36 and 38 by conductive splices 40 and 42 formed of brass, or other suitable, material, and which are clamped to the lead wires and to the respective pins. The initiator is activated by applying an electric signal to lead wires 36 and 38, the signal being conducted through the pins 12 and 14 to the bridgewire 16. The bridgewire accordingly heats up, and ignites the ignition charge 22 which, in turn, ignites the output charge 30.

Figure 3:
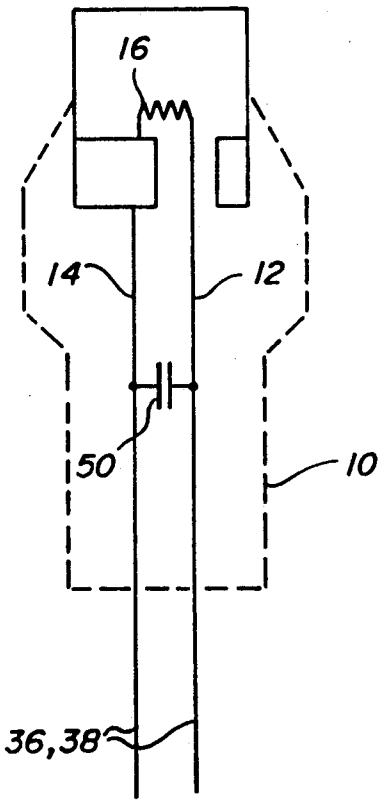
FIG. 3 is a schematic representation of the firing circuit of the initiator of FIG. 2.
Figure 2:
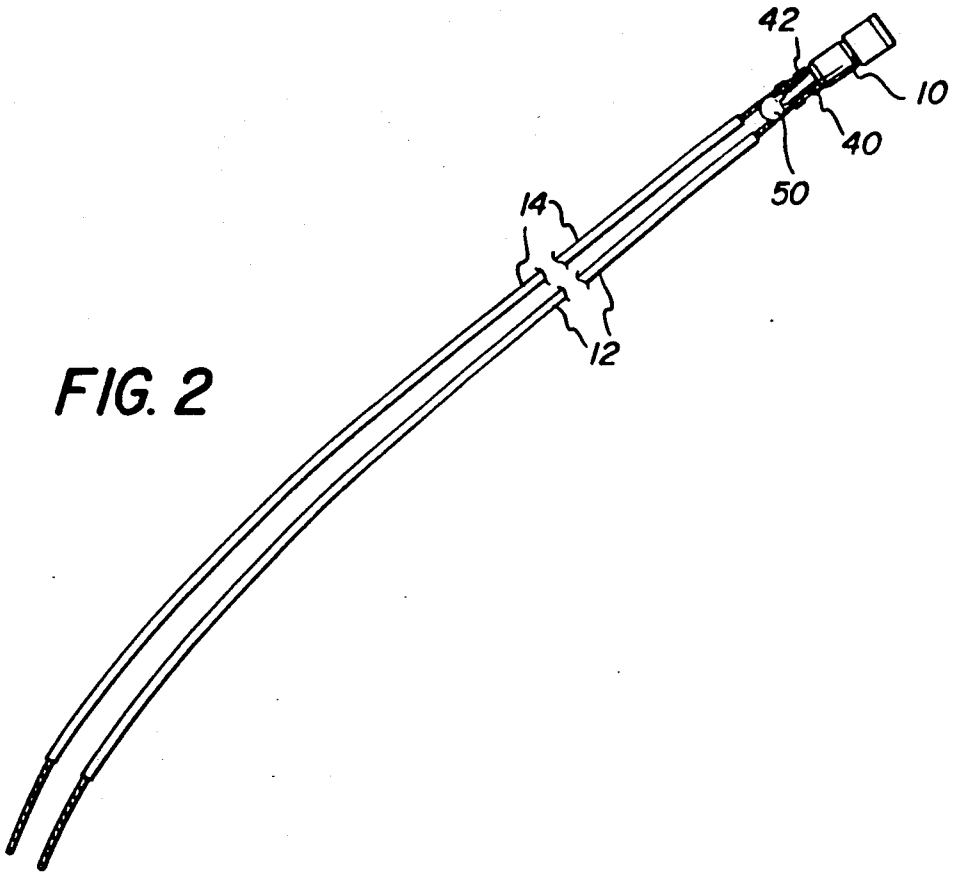
FIG. 2 is a perspective view of the initiator of FIG. 1 together with appropriate leads connected to the terminal pins of the initiator, and including a capacitor connected across the pins, in accordance with the teachings of the present invention.

In accordance with the present invention, and is shown in FIGS. 2 and 3, a capacitor 50 is connected across the pins 12 and 14 of the initiator, specifically to absorb electrostatic discharges and thereby protect the bridgewire 16 from spurious ignition due to such discharges. Specifically, in a constructed embodiment of the invention, capacitor 60 is a 0.33 microfared ceramic capacitor whose leads are resistance welded to splices 40 and 42. The voltage rating of the capacitor is 50 V.

Figure 4A:
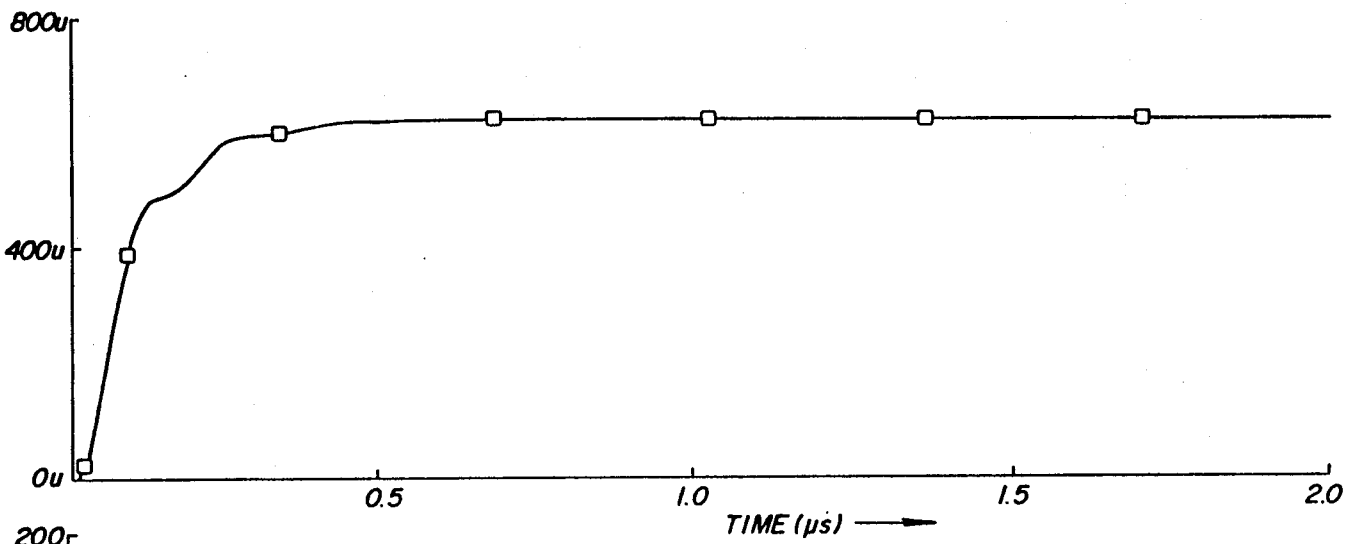
FIGS. 4A AND 4B are curves showing the total energy introduced to the bridgewire of an initiator, such as the initiator of FIG. 1, and the voltage across the bridgewire and current through the bridgewire, during a typical test.
Figure 4B:
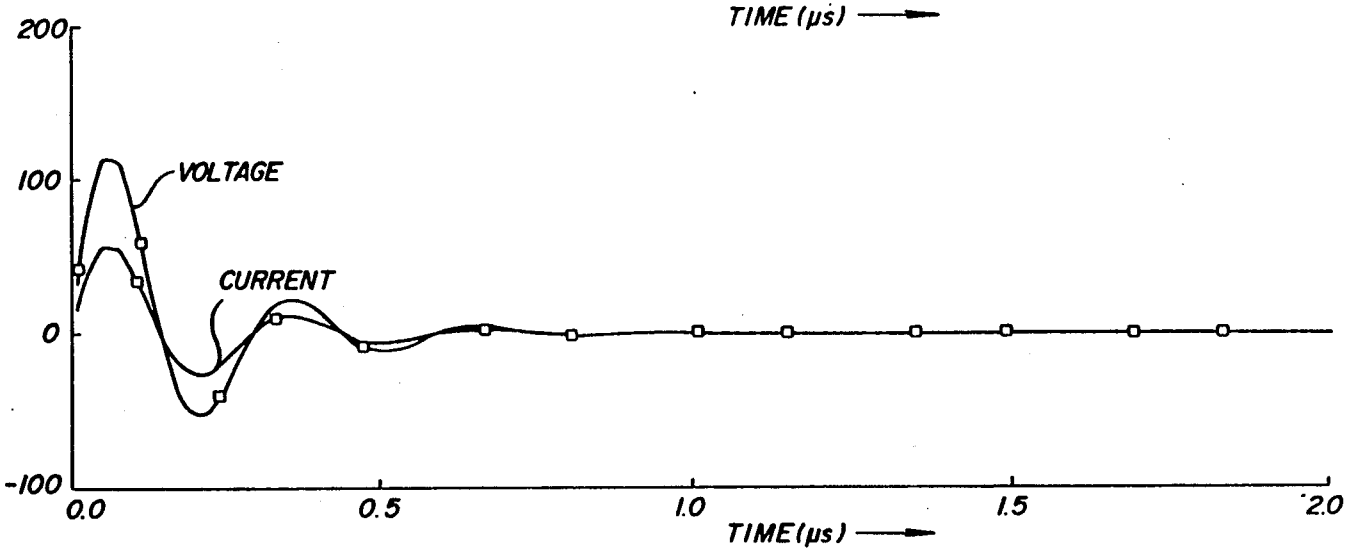
Figure 5A:
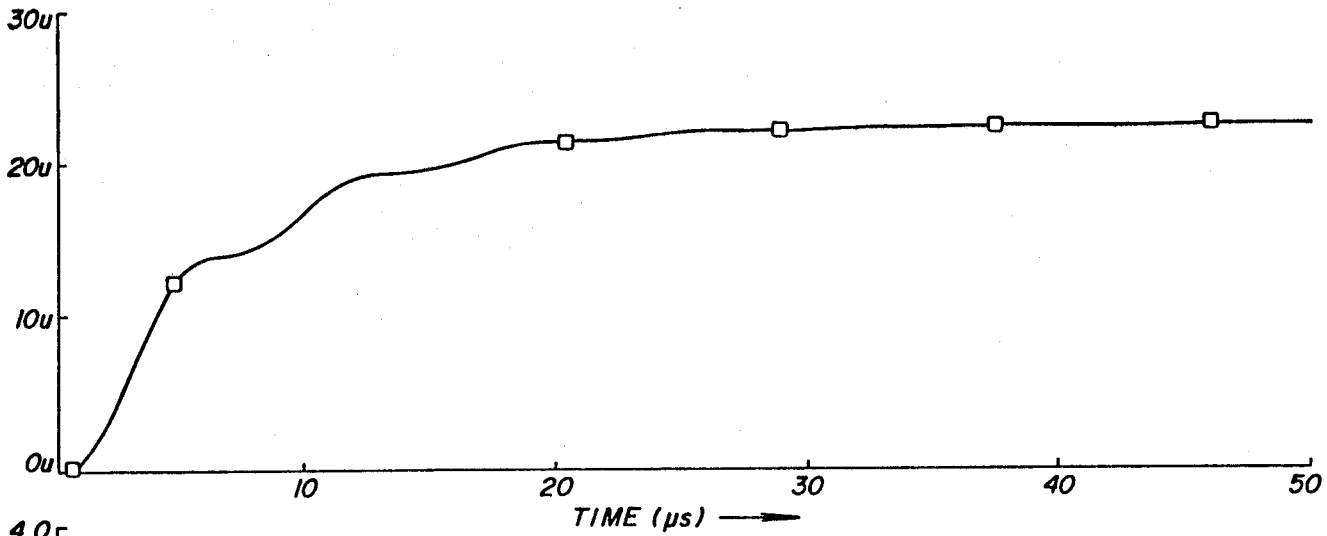
FIGS. 5A and 5B are curves showing the reduction in energy introduced to the bridgewire, and the reduction in voltage across and current through the bridgewire during an identical test, but with the capacitor connected across the pins of the initiator as shown in FIGS. 2 and 3.
Figure 5B:
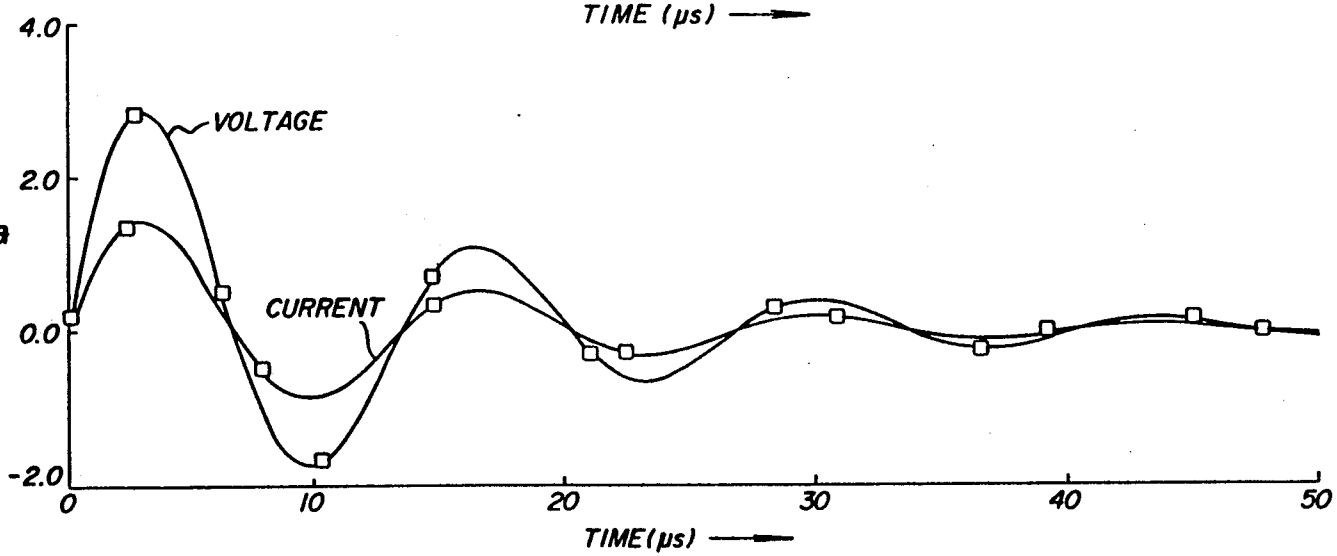

The curves of FIGS. 4A and 4B show the performance characteristics of the initiator of FIG. 1 without the capacitor 50, and the curves of FIGS. 5A and 5B show the performance characteristics of the initiator of FIGS. 2 and 3 with the addition of capacitor 50.

FIGS. 4A and 5A show the total energy supplied to the bridgewire, and FIGS. and 4B and 5B show the voltage and current across and through the bridgewire, as a function of time. It will be observed from the curves that the use of capacitor 50 causes the total energy supplied to the bridgewire, as well as the voltage and current across the bridgewire to be substantially reduced.

The curves of FIGS. 4A, 4B and 5A and 5B are the results of tests conducted on a total of 40 initiators, 10 unprotected and 10 each with varying values of capacitor 50, namely, 0.1 uf 0.33 uf and 1.0 uf. Each initiator was subjected to 30 consecutive pulses from a 460 uf capacitor charged to 30 kV, and discharged through a 150 ohm series resistor. Total pulse energy (0.5 KV exceeded the severe test described above by a fact or of 4.4. All ten unprotected initiators fired, nine on the first pulse and one on the second pulse. One out of ten units fitted with a 0.15 uf capacitor failed on the sixth pulse. The remaining nine initiators showed a significant reduction in bridgewire resistance after testing, an indication that the bridgewire had seen a substantial electrostatic discharge pulse. None of the ten units fitted with a 0.33 uf capacitor fired, and they showed only a very slight reduction in bridgewire resistance. None of the ten units fitted with a 1.0 uf capacitor fired, and none showed any change in bridgewire resistance.

The invention provides, therefore, a simple initiator which incorporates a capacitor connected across its terminal pin to render its bridgewire immune from firing in the presence of electrostatic discharges.

It will be appreciated that while a particular embodiment of the invention has been shown and describe modifications may be made. The present invention is intended to cover all such modifications as set forth in the following claims.

I claim:

1. An electro-explosive initiator constructed to be immune from electro-static discharge pulses resulting from ambient electro-static fields encountered by the initiator, said initiator comprising:

a casing;

an explosive charge mounted within said casing;

a bridgewire mounted within said casing for igniting said charge in response to an electric current through said bridgewire;

first and second terminal pins directly connected to said bridgewire for supplying an electric current to said bridgewire for igniting said explosive charge;

first and second leads;

first and second splice members respectively connecting said leads to said first and second pins; and a discrete capacitor having a capacity substantially in the range of 0.1 microfarad to 10.0 microfared, said capacitor having first and second lead wires respectively connected to said leads to said first and second splice members whereby substantially all of the energy of an electro-static discharge pulse resulting from an ambient electro-static field encountered by the initiator is shunted so as to prevent energy resulting from said discharge pulse from reaching the bridgewire.

2. The initiator defined in claim 1, in which said lead wires of said capacitor are resistance welded to said first and second splice members.

3. The initiator defined in claim 1, in which said capacitor capacity of the order of 0.33 microfarads.

4. The initiator defined in claim 1, in which said capacitor has a voltage rating of the order of 50 Volts.

5. The initiator defined in claim 1, and which includes a radio frequency filter interposed between said first and second terminal pins to absorb radio frequency signals and prevent spurious ignition of the initiator by such signals.

* * * * *